United States Patent [19]

Williams

[11] 4,430,967

[45] Feb. 14, 1984

[54] TWO CYCLE DIESEL ENGINE

[76] Inventor: Robert H. Williams, Rt. 2, Box 44, Bandera, Tex. 78003

[21] Appl. No.: 346,609

[22] Filed: Feb. 8, 1982

[51] Int. Cl.[3] ..... F02B 33/24

[52] U.S. Cl. ..... 123/65 VA; 123/73 AF; 123/73 S; 123/197 R

[58] Field of Search ..... 123/65 VA, 73 A, 73 AE, 123/73 AF, 73 S, 197 R, 197 A, 197 AB, 225

[56] References Cited

U.S. PATENT DOCUMENTS 867,782 10/1907 Bayer ..... 123/225
1,763,959 6/1930 Finch ..... 123/65 VA

FOREIGN PATENT DOCUMENTS 1285061 1/1962 France ..... 123/73 S

*Primary Examiner*—Michael Koczo

[57] ABSTRACT

The invention engine comprises a compressor with a rotary piston in a cylinder bore in a stator and a U-shaped box-like combustion-expansion compartment, conveniently called a U-box, immediately above and riding on the rotary piston, the U-box and the compressor unit contained between the same parallel end walls. The rotary piston is eccentrically mounted on a shaft which is concentric with the cylinder bore and is supported in bearings in the end walls. A wiper blade is fitted in a groove across the piston head to yieldably sweep the cylinder bore to generate a suction stroke behind it, drawing in air via a one-way inlet port in the perimeter of the cylinder, and a compression stroke ahead of it to compress the air drawn in during the preceding suction stroke. The U-box is in the shape of a rectangular plate bent upward at two places to form two parallel vertical sides of equal height and a base plate between them. It is closed on its ends by the end walls, between which it reciprocates; it is closed above by a fixed casting to form a compression head; and its vertical sides recede into channels in the stator as the piston forces it upward on the upward compression stroke, the piston at the same time compressing air into the U-box via one-way inlet ports in the box's counter-clockwise face. A combustion-expansion chamber is formed between the inside of the U-box and the compression head. A fuel injector and a glow plug ignite a fuel charge when the piston head is near top center, and expanding gases force the U-box downward from the compression head, causing the eccentric piston to rotate. Parts through the stator on a level with the combustion chamber vent the engine as the vertical sides of the U-box drop downward past them and uncover them, at the end of the power stroke, the U-box sides re-covering them on their next upward compression stroke.

6 Claims, 5 Drawing Figures

TWO CYCLE DIESEL ENGINE

SUMMARY OF THE INVENTION

The subject invention is a simple, well-scavenged two-cycle engine inhaling two-and-a-half to three times as much air as a conventional piston engine of equal displacement can inhale without a supercharger. It requires no cam-operated intake or exhaust valves, and the inlet and exhaust ports are so large as to avoid choking. The combustion chamber is completely surrounded by at least one set of yieldable seals and optionally by two or three sets, enabling the engine to operate at diesel pressures, with fuel injection and compression ignition, preferably aided by one or more glow plugs in each combustion chamber.

The compressor raises the air to above 200 pounds per square inch in a first stage of compression, boosting it to 300 pounds or higher in a second stage.

The engine is optionally operated at lower levels of compression by equiping it with a larger combustion chamber, a preferred level being around 200 pounds per square inch, with a compression ratio of 13:1 or 14:1. Operated at this level of compression, the engine is injected preferably with a fuel with a flash point somewhere between that of white gasoline and that of No. 2 diesel, for spark plug ignition. In this operation, as when performing as a diesel, all the available air is drawn in without restriction, the speed and power of the engine determined by the fuel charge.

DETAILED DESCRIPTION OF THE PREFERRED EMBODIMENTS

Figure 1:
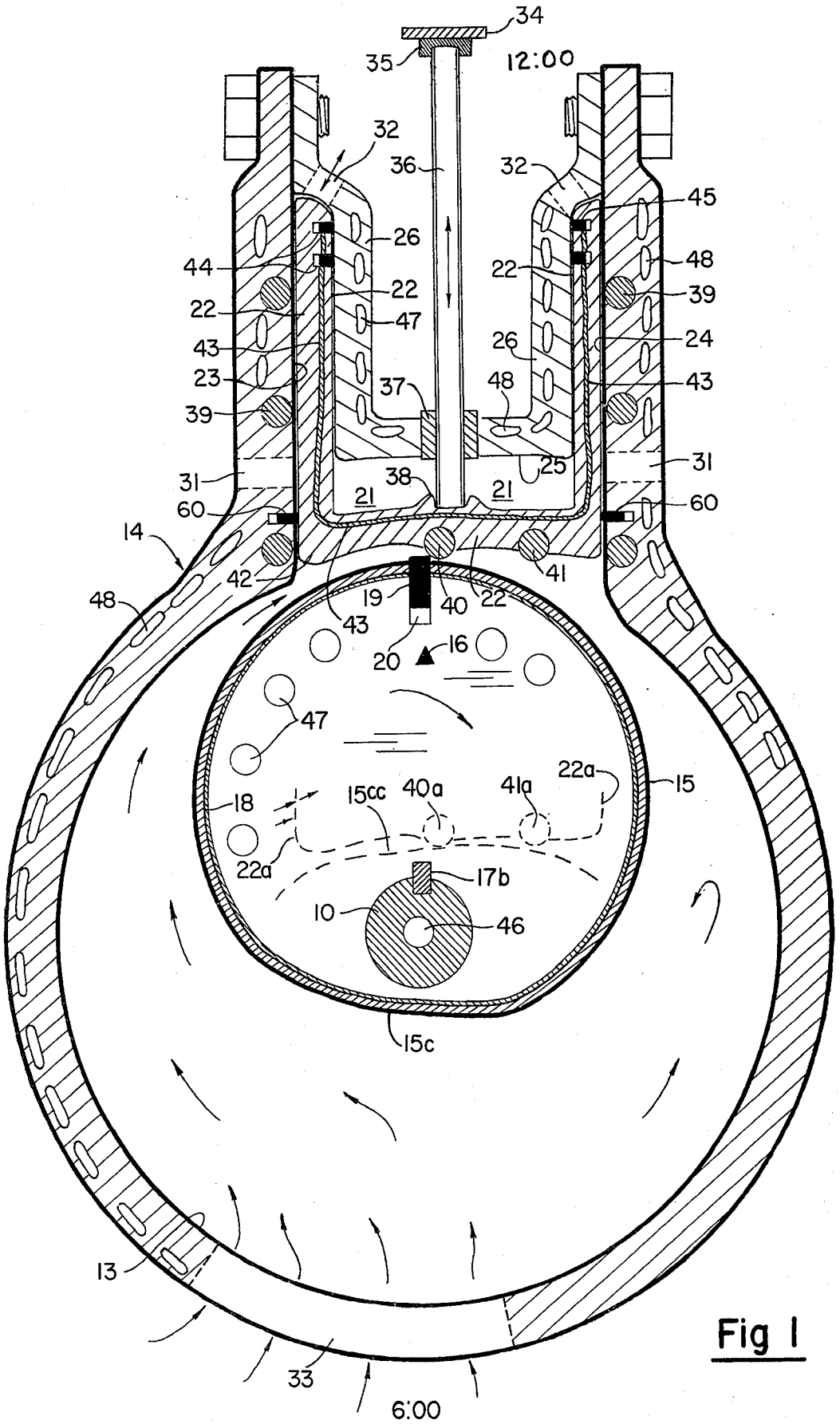
FIG. 1 is an end view of the invention engine on a vertical plane midway between the end walls showing the U-shaped combustion compartment, or U-box, riding on the piston, with the piston head at 12:00 o'clock. Broken lines 22*a* show the position of the U-box on a flattened span of the short-radius side of the piston at 15 cc, while the engine is being vented, arrows indicating compressed air flowing from the compressor into the expansion chamber.
Figure 2:
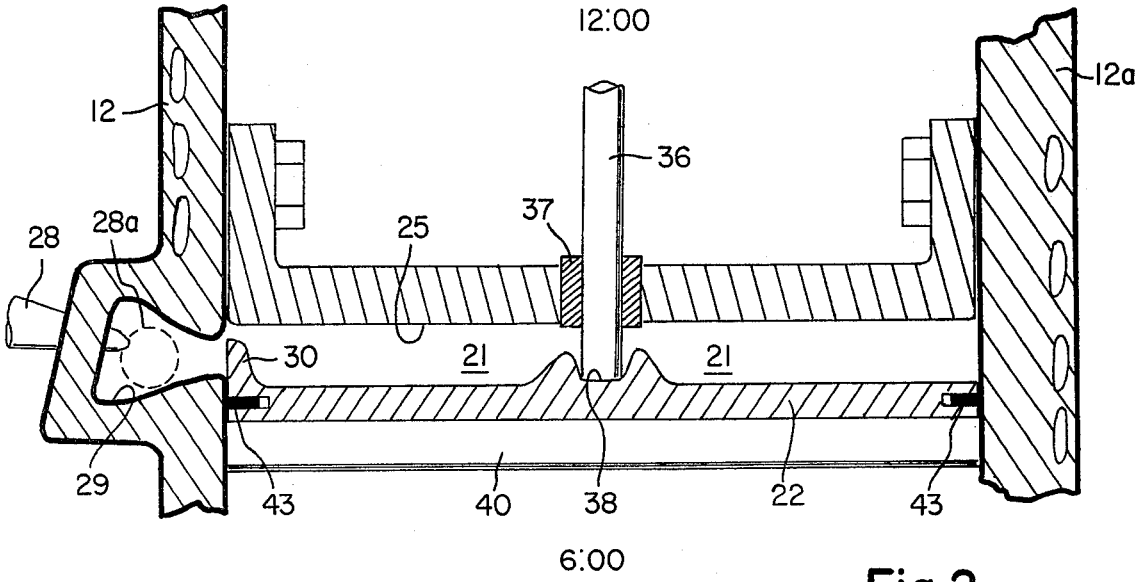
FIG. 2 is a sectional side view of the combustion chamber at maximum compression, on a vertical plane from 12:00 to 6:00 o'clock, showing an optional pre-chamber, 29. Broken-line circle 28*a* indicates a preferred position of the glow plug (or spark plug) in one end of the pre-chamber.

An engine shaft 10 is supported in bearings 11 in parallel end walls 12 and 12*a* which seal between them a cylinder bore 13 in stator 14, the bore concentric with the engine shaft. Eccentric rotary piston 15, generally annular but with an optional flattening on its short-radius side, with hubs 17, is keyed to the shaft by key 17*b*, its off-center head, 16, barely clearing the cylinder bore. At least one compression end seal, 18, is fitted into a groove on each end of piston 15 to maintain yieldable sliding engagement with the end walls. Wiper blade 19 is fitted into slot 20 across the piston head at its longest radius, the blade spring-biased outward to sweep the cylinder bore to suck air into the cylinder through one-way inlet port 33 during a clockwise suction stroke and at the same time to compress the air drawn in during the preceding suction stroke into a combustion-expansion chamber.

The combustion-expansion chamber, 21, is housed in a U-shaped box-like compartment, or U-box, 22, which is open at top and closed on its sides by the end walls, the vertical sides of the U-box being of equal height and the box fitted slidably between the end walls with conventional seals. The U-box rides at all times on the piston, reciprocating vertically between the end walls and between vertical faces 23 and 24 of the stator as the piston rotates. The counter-clockwise face of the U-box is fitted with conventional one-way valves to function in slots 27 to admit air compressed by the piston and to prevent combustion gases from flowing back out of the combustion-expansion chamber. Combustion-expansion chamber 21 is formed inside box 22, between the end walls and between its bottom and a head, 25, which is the bottom of a second box-like element, 26, a casting fitted downward into the U-box, its ends and sides turned vertically upward to form flanges, the end flanges fitting closely against the end walls and bolted to them, the side flanges spaced out from vertical stator faces 23 and 24 to provide channels into which the vertical sides of the U-box rise on their upward travel, the flanges extending above the limit of their upward travel, then drawn over to meet the vertical stator faces and bolted to them. Ports 32 are cut in the upper ends of the channels. Compression head 25, a casting, is fitted down inside the U-box and fixed in place a pre-determined distance above the bottom of the box when the box is at the extremity of its upward travel, according to the compression ratio desired.

Fuel injector 28, to inject a suitable distillate, such as No. 2 diesel, when rotor head 16 is near top dead center, is installed preferably in pre-chamber 29. Ignition is by conventional means, preferably by compression, aided by one or more glow plugs (not shown). Small flange 30, projecting upward from the inside bottom of box 22, to slide closely against an end wall, covers the throat of pre-chamber 29, almost sealing off the pre-chamber from the main part of chamber 21 long enough for fuel injection and ignition, the flange then receding as rotor head 16 travels on past top center, gradually opening the pre-chamber to allow the flame to spread gradually into the main chamber. Combustion gases expanding inside chamber 21 against fixed head 25 and the end walls drive box 22 downward causing eccentric rotor 15 to rotate.

Horizontal port 31 is cut through the stator near the base of each of its vertical faces, 23 and 24, and a port, 32, is made in the upper end of each of the vertical channels, the four ports so positioned that they are opened simultaneously to vent combustion-expansion chamber 21 as the sides of U-box 22 drop down out of their respective channels—after the piston head passes 4:00 o'clock, the end of the expansion stroke. The venting of the engine is accelerated by the action of inlet valves in slots 27, which admit air to the expansion chamber to sweep it clean as soon as the pressure inside that chamber drops below the pressure of the air in the compressor, which is a few pounds per square inch at this state of compression. As soon as the eccentric piston begins to lift the U-box on the upward compression stroke the sides of the U-box re-cover the horizontal exhaust ports and the tips of the U-box sides re-enter their channels closing off ports 32, sealing the combustion-expansion chamber to catch the next charge of compressed air.

An optional device for lengthening the downward travel of the U-box and for quickly opening and re-closing the exhaust ports, in relation to piston travel, to let the combustion-expansion chamber catch a maximum charge of air for the next cycle, comprises a slight flattening of the face of piston 15 for a span of forty to sixty degrees along part of the short radius of the piston where the flattening allows the U-box to drop precipitously just after the piston head passes 4:00 o'clock, the end of the expansion stroke. The flattened span (at 15*c*, FIG. 1, shown also in broken lines at 15 cc when the piston head is near 5:00 o'clock) terminates somewhat abruptly to start the U-box upward promptly after the engine is vented, making it possible to vent the engine and re-close the exhaust ports by the time the piston head reaches the vicinity of 6:00 o'clock.

Intake port 33 is so positioned that it does not admit air to cylinder bore 13 till piston head 16 reaches 5:30 o'clock, creating a partial vacuum in the space counter-clockwise of the intake port to help draw the U-box downward when the engine is being started, before a fuel charge is ignited to drive it downward.

In case the U-box is not in contact with the piston at starting it must make contact as soon as the piston is rotated by the starter to top center, and the vacuum is generated under the U-box beginning at that point.

Optionally the U-box is biased downward at all times by spring tension, which may be applied to the tips of the vertical sides of the U-box or on the upper end of a rod, as shown in FIG. 1, wherein strap spring 34 is fitted with socket 35 to ride on top of rod 36, bearing it downward through bearing 37 (with a seal, not shown) into socket 38 on the upper face of the bottom of the U-box.

Roller bearings 39, 40 and 41 are used to lessen friction, and those (39) in vertical faces 23 and 24 of the stator also transfer heat away from the sides of the U-box. Roller bearings 40 and 41 are so positioned on the under side of the U-box that they carry the load of combustion, the first one, 40, till piston head 16 reaches approximately 1:30 o'clock, the second bearing, 41, taking over and driving the eccentric piston to the end of the power stroke.

These bearings are lubricated by an oil mist sprayed into the air at intake port 33, both behind and ahead of piston head 16, the suddenly-broken vacuum sucking the mist counter-clockwise and the air pressure ahead of the piston head spreading it clockwise. Piston 15 is cooled by pressurized oil pumped through the engine shaft via duct 46 and through cooling veins 47. The pressurized oil also coats the end walls to lubricate end seals 18.

The edge, 42, at the base of the counter-clockwise side of the U-box is somewhat rounded to insure smooth passage of wiper blade 19 in the piston head from the face of cylinder 13 to the under side of U-box 22.

Edge 42 is so shaped and in such geometric relationship with the rest of the bottom of the U-box, and the U-box so positioned across the top of the cylinder, that edge 42 makes sliding sealing engagement with the face of piston 15 throughout the upward compression stroke.

In the preferred design the cubic volume of the combustion chamber at the end of the first stage of compression is such that the compressor raises the air pressure in the chamber to about 220 pounds per square inch, and the positioning of U-box base 22 across the top of the cylinder bore is such that the onward travel of the eccentric piston, after the end of the first stage of compression when piston head 16 is in the vicinity of 11:00 o'clock, causes the U-box to continue to move upward in a second stage of compression till the piston head reaches top center, raising the pre-ignition air pressure well above 300 pounds, providing a compression ratio of 20:1 or 21-to-one, a preferred level for efficient operation by compression ignition, with No. 2 diesel fuel.

Room for a third set of end seals is optionally provided, without having to otherwise thicken the base plate and the sides of the U-box, by forming a flange along each end of the U-box to barely clear the end walls.

All seals in the invention engine are at all times vertical to the opposed faces. Seals completely surround the combustion-expansion box, end seals 43 butting against transverse seals 44 and 45.

One-way valves in slots 27 are of conventional design, a preferred type comprising a roller 27*a*, preferably to fly inward in its slot when compressed air in the compressor is greater than the pressure inside the combustion-expansion chamber, and to fly back and seal off the slot at the end of the compression stroke.

Figure 3:
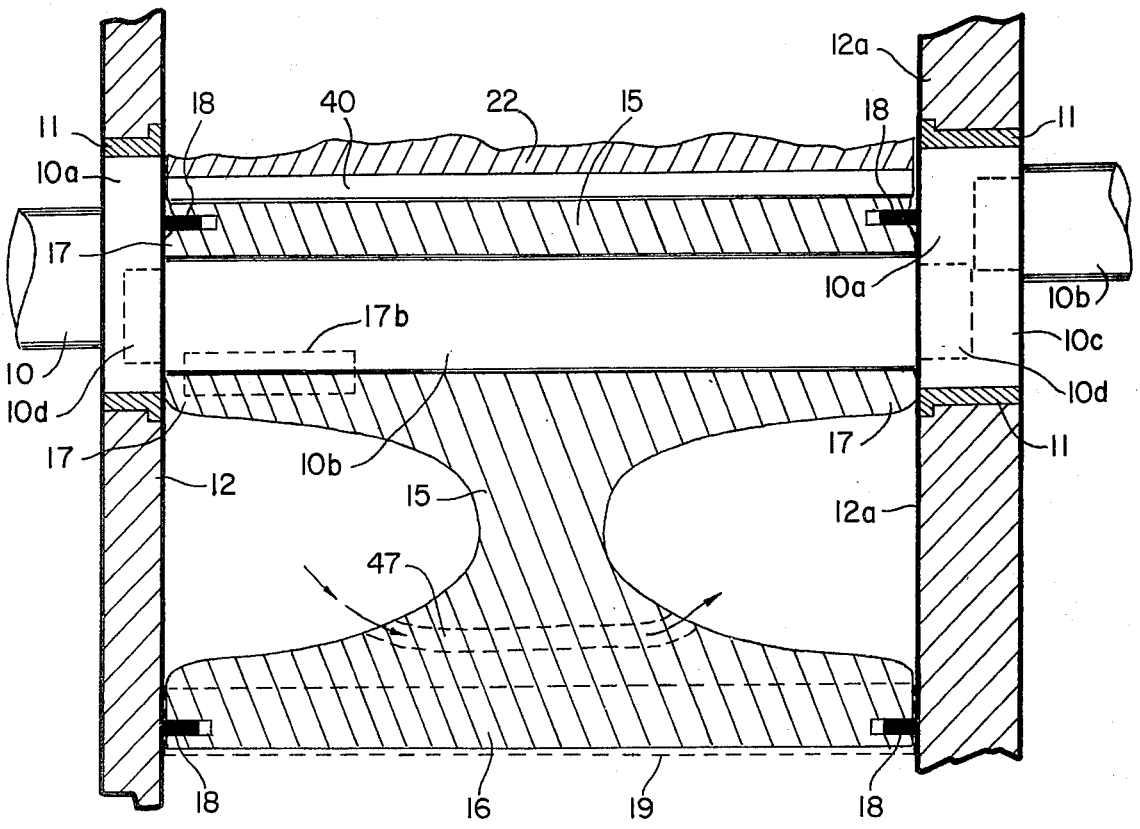
FIG. 3 is a vertical cross-section of the compressor unit, downward from 12:00 o'clock, with the piston head downward, showing an eccentric shaft 10*b*, for each cylinder.
Figure 4:
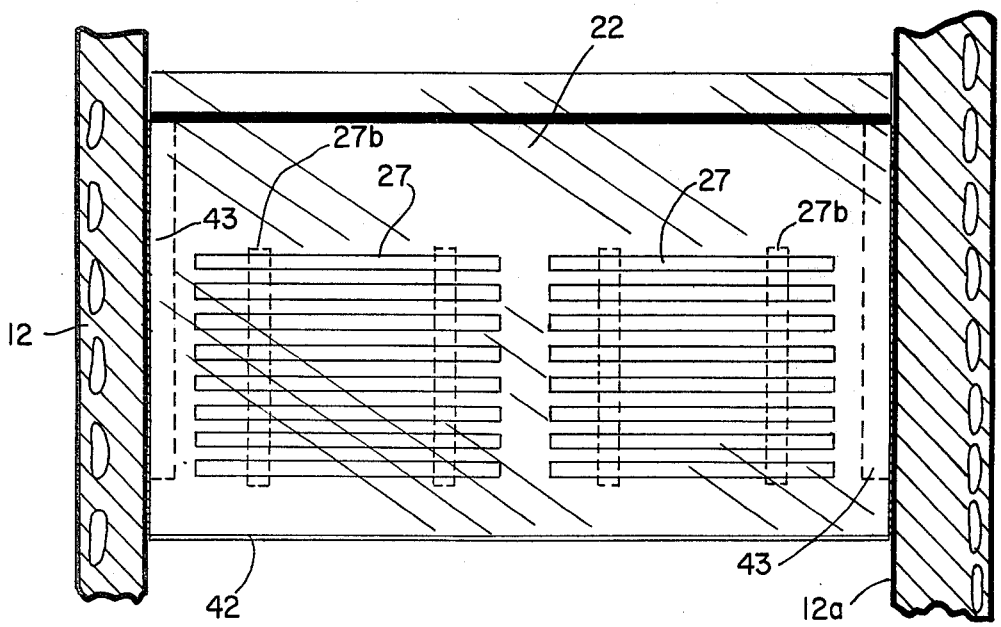
FIG. 4 is a side view of the counter-clockwise vertical face of the U-box showing air inlet slots 27, broken lines 43 indicating the position of end seals and broken lines 27*b* indicating bars across the inside face of the slots to keep the valve rollers from flying out of their slots during the compression stroke.
Figure 5:
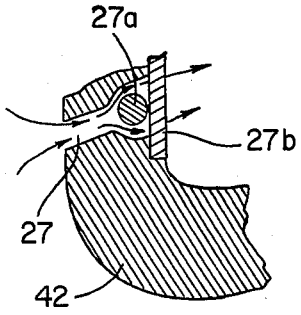
FIG. 5 is a cross-sectional end view of one of the slots across the vertical face of the U-box, with valve roller 27*a* admitting air to the combustion chamber and showing restraining bar 27*b*.

The capacity of the compressor is optionally increased and the engine stroke somewhat lengthened by use of an offset shaft for each cylinder of the engine. This means (FIG. 3) comprises a short shaft, 10*b*, for each cylinder, the shaft squared at its ends, 10*d*, and fitted into squared sockets in hubs 10*a*. If a second cylinder adjoins the first, the hub, 10*c*, in the partition end wall is thickened to make room for sockets for both the floating shafts. Main engine shaft 10 outside the end wall, is integral with and concentric with hub 10*a*, which hub is concentric with cylinder 13. Both hubs are annular and rotate in bearings 11 in the end walls. Since shaft 10*b* is eccentric with the cylinder, piston 15 can be of somewhat smaller diameter, allowing more space in the cylinder for air and allowing the traveling U-box to drop deeper into the cylinder space, lengthening the stroke and enlarging the cubic volume if the expansion chamber in the U-box.

OPERATION

The subject engine has the four phases of intake, compression, expansion and exhaust with each revolution of the engine shaft. FIG. 1 shows reciprocating combustion compartment, or U-box, 22 virtually at the position of maximum compression, ready for fuel injection and ignition of the fuel charge. Ignition is by compression aided by a glow plug when the engine operates as a diesel; by spark plug when it operates at a lower level of compression, as determined at the factory. Combustion gases expanding against fixed compression head 25 drive the U-box downward, forcing eccentric piston 15 to rotate. The under side of the U-box is so shaped and roller bearings 40 and 41 so positioned that the power is transferred to the piston entirely via the roller bearings, the first one, 40, carrying the load till piston head 16 reaches about 1:30 o'clock, the second one, 41, carrying the load through the rest of the power stroke.

As the piston head is forced clockwise from top center it generates a partial vacuum behind it till it reaches intake port 33, when air rushes in to fill the vacuum. At the same time piston head 16 compresses the air ahead of it which was sucked into the cylinder during the preceding revolution, intake port 33 being fitted with one-way inlet valves, such as reed-type valves. Immediately after piston head 16 passes 4:00 o'clock the upper extremities of the two vertical sides of U-box 22 begin to uncover slotted exhaust ports 31 in the stator and at the same time the vertical sides drop out of their channels, allowing the channels to help vent the engine via ports 32. Piston 15 optionally is slightly flattened along part of its short radius side for a pre-determined span so that when piston head 16 is a little past 4:00 o'clock the shortened radius of the piston lets the U-box sides drop suddenly to quickly uncover the horizontal ports and drop out of their channels, to quickly vent the engine, the flattened span of the piston ending abruptly to start the U-box upward to re-close the four ports by the time the piston head reaches the vicinity of 6:00 o'clock, thus allowing the combustion-expansion chamber to catch a maximum charge of air for the next cycle. Venting is accelerated by compressed air flowing into the combustion-expansion chamber via the one-way valves in slots 27 to sweep out the spent gases.

As the piston forces the U-box upward it continues to pump air into chamber 21 till the piston head reaches the vicinity of 11:00 o'clock, the end of the first stage of compression, after which the piston head continues to force the U-box upward in a second stage of compression till the head reaches top center, squeezing the air in chamber 21 to a pre-determined compression ratio.

Fuel is injected by injector 28 into the compressed air in the combustion chamber, preferably into sub-chamber 29 in one of the end walls, the sub-chamber opening via a narrow throat into main chamber 21. An ignition device, such as a glow plug, is positioned where it will help ignite the fuel spray from the injector, as indicated by broken-line circle **28*a*. Small flange 30 on the inside of the U-box, on the upper face of the bottom of the box, slides against the end wall and covers the sub-chamber throat while the U-box is at the limit of its upward travel, long enough for injection and ignition of a fuel charge in the sub-chamber, the flange dropping downward as eccentric piston 15 travels on from top center, uncovering the throat of sub-chamber 29 to let the flame of combustion spread throughout the main chamber. The onward travel of the piston, driven downward by expanding combustion gases which force the U-box downward, provides a gradual opening of the throat of sub-chamber 21**, smoothing out combustion process to avoid hammering and a peak of heat which would generate excessive nitrous oxides.

I claim:

1. A rotary internal combustion engine having a rotary compressor compartment and a combustion-expansion compartment, both sealed between the same parallel end walls, the compressor compartment comprising a cylinder bore in a stator, a rotary piston fixed eccentrically to a shaft which is journaled in the end walls, the piston to travel clockwise, its head barely clearing the cylinder bore, fitted with a transverse wiper blade spring-biased outward in a slot on the longest radius of the eccentric piston to yieldably sweep the cylinder bore to compress air into the combustion-expansion compartment;

the stator having a first face turned vertically upward from the cylinder bore in the vicinity of 11:00 o'clock and a second face turned vertically upward between 1:00 and 2:00 o'clock, the two parallel faces enclosing, with the end walls, a rectangular space above and communicating with the cylinder space, the rectangular space being a cavity into which the combustion-expansion compartment recedes on its upward travel;

the combustion-expansion compartment comprising a U-shaped element, or U-box, in the form of a rectangular metal plate bent vertically upward at two places to form a U, its sides of equal height, the compartment closed on its ends by the end walls, fitted closely and slidably between the end walls and between the vertical faces of the stator with yieldable seals, the U-box to ride at all times on the eccentric piston to reciprocate upward with it into the stator space and downward with it into the cylinder space, the U-box closed above by a rectangular casting fitted downward inside the U, its ends and sides turned upward to form bolting flanges, the end flanges bolted to the end walls, the side flanges extending above the extremity of upward travel of the vertical sides of the U-box, thence drawn over to meet the vertical faces of the stator and bolted to them; the side flanges and vertical stator faces thus forming vertical channels, closed by the end walls, into which channels the vertical sides of the U-box recede during their upward travel, the bottom of the inserted casting constituting a combustion chamber head, or compression head, and the chamber enclosed inside the U-box between the end walls and between the compression head and the bottom of the U-box constituting a combustion-expansion chamber;

the U-box fitted with one-way inlet valves on its counterclockwise vertical side to admit air compressed by the clockwise-rotating piston in a first phase of compression, pressure inside the combustion-expansion chamber forcing the valves shut as the U-box travels upward into the stator space at the end of the first phase of compression, in which the piston finishes pumping the air out of the cylinder bore into the U-box when the piston head arrives at the base of the counterclockwise vertical face of the stator in the vicinity of 11:00 o'clock;

the U-box so positioned across the top of the cylinder bore that its base forms roughly a chord to cause the eccentric piston head to continue to force the U-box radially upward till the piston head reaches top center, the function constituting a second phase of compression to squeeze the combustion chamber to a smaller volume to raise the level of air pressure in the combustion chamber;

a fuel injector positioned to inject a charge of fuel into the compressed air in the combustion chamber and the fuel ignited by ignition means in timed relation to the position of the piston head when it is near top center, to produce a timed expansion of the combustion gases to force the U-box downward to cause the piston to rotate in a clockwise direction;

a horizontal port through the stator near the base of each of the two vertical stator faces on a level with the combustion chamber and a port in the upper end of each of the two vertical channels, the four ports to vent the engine after the piston head passes 4:00 o'clock, the downward travel of the eccentric piston allowing the sides of the U-box to drop past the horizontal ports to uncover them and at the same time drop out of their respective channels to uncover the ports in the channels;

the one-way inlet valves in the counter-clockwise face of the U-box yieldable, to admit air when the pressure inside the combustion-expansion chamber drops below that of the air in the compressor, a few pounds per square inch at this stage of compression, to let the compressed air quickly sweep the spent gases out of the combustion-expansion chamber;

the U-box caused to start its upward course by the clockwise travel of the eccentric piston to force the sides of the U-box upward closing off the horizontal ports and closing the vertical channels to re-seal the combustion chamber for the next charge of compressed air.

2. The engine of claim 1 with the face of the piston somewhat flattened on the side approximately opposite its head for a pre-determined span to allow the U-box to drop precipitously a little further down than it would otherwise travel at the end of the power stroke, to quickly drop its vertical sides past the horizontal exhaust ports and out of the vertical channels to open the four ports to quickly vent the engine, the flattened span terminating at such a position as to allow the curvature of the piston to force the U-box upward to close off the horizontal ports and close the vertical channels by the time the piston head reaches the vicinity of 6:00 o'clock.

3. The engine of claim 1, with spring tension applied to the U-box to bias it downward against the rotor at all times, the tension applied by spring pressure on the upper end of a rod of small diameter outside the engine, the lower end of the rod passing downward through a bearing in the compression head into the combustion-expansion chamber and seated in a socket on the inside of the bottom of the U-box, the rod to reciprocate through the bearing as the U-box reciprocates.

4. The engine of claim 1, with means for permitting use of a smaller piston and lengthening the stroke, the means comprising an eccentric shaft for each individual cylinder, the individual shaft mounted eccentrically in a rotating hub in each end wall, the hubs concentric with the cylinder bore, flush on their inner faces with the inner faces of the end walls and substantially larger in diameter than the diameter of the cylinder shaft, the shaft squared on its ends and fitted into squared sockets in the hubs, the piston fixed eccentrically to the eccentric cylinder shaft; the main engine shaft being outside the end walls, concentric with the hubs and integral with them.

5. The engine of claim 1, with roller bearings mounted on the under side of the U-box parallel to the engine shaft, centered between 12:00 and 1:30 o'clock, to bear on the piston throughout the power stroke to reduce friction in the transfer of power from the U-box to the piston.

6. The engine of claim 1 and an ignition pre-chamber of small volume cast on the outside of an end wall with a narrow throat opening into the combustion chamber; a small flange turned upward on the edge of the bottom of the inside of the U-box in such a position that it covers the throat of the pre-chamber when the U-box is at the limit of its upward travel, virtually closing off the small volume of air trapped in the pre-chamber long enough for injection and ignition of a fuel charge, the flange drawn downward with the dropping of the U-box as the eccentric piston travels on from top center, to allow the flame to spread out of the pre-chamber into the main combustion chamber;

a fuel injector positioned to inject a charge of fuel into the pre-chamber and ignition means for igniting the charge in timed relation to the position of the piston head.

* * * * *